US008770465B2

(12) United States Patent
Rometty et al.

(10) Patent No.: US 8,770,465 B2
(45) Date of Patent: Jul. 8, 2014

(54) CORNER LOCK BOARD

(75) Inventors: John A. Rometty, Barrington, IL (US); Lloyd W. Lenig, Plymouth, IN (US); Mitchell Snyder, Chalfont, PA (US)

(73) Assignee: Premark Packaging LLC, Glenview, IL (US)

( * ) Notice: Subject to any disclaimer, the term of this patent is extended or adjusted under 35 U.S.C. 154(b) by 562 days.

(21) Appl. No.: 12/704,363

(22) Filed: Feb. 11, 2010

(65) Prior Publication Data

US 2010/0206942 A1 Aug. 19, 2010

Related U.S. Application Data

(60) Provisional application No. 61/152,365, filed on Feb. 13, 2009.

(51) Int. Cl.
*B65D 3/10* (2006.01)

(52) U.S. Cl.
USPC ..... 229/5.5; 229/198.2; 206/453

(58) Field of Classification Search
USPC ..... 229/198.2, 67.3; 220/600; 40/740, 794, 40/791
See application file for complete search history.

(56) References Cited

U.S. PATENT DOCUMENTS

| | | | | |
|---|---|---|---|---|
| 1,035,634 | A | 8/1912 | Platt | |
| 1,069,021 | A | 7/1913 | Miller | |
| 1,102,820 | A | 4/1914 | Thompson | |
| 1,126,246 | A * | 1/1915 | Maier | 229/196 |
| 1,195,539 | A * | 8/1916 | Waltz | 206/389 |
| 1,352,863 | A | 9/1920 | Zietler et al. | |
| 1,619,011 | A | 3/1927 | Agar | |
| 1,758,230 | A | 5/1930 | Lange | |
| 1,791,003 | A | 2/1931 | Shearer | |
| 1,819,933 | A | 8/1931 | Watson | |
| 1,871,888 | A | 8/1932 | Johnson | |
| 1,880,191 | A | 10/1932 | Bigelow | |
| 1,976,209 | A | 10/1934 | Ashe | |
| 2,077,694 | A | 4/1937 | Winton | |
| 2,122,904 | A | 7/1938 | Ambrosius | |
| 2,194,669 | A | 3/1940 | Mumford | |

(Continued)

FOREIGN PATENT DOCUMENTS

| | | |
|---|---|---|
| DE | 8714938 | 3/1988 |
| EP | 1405793 | 11/1978 |

(Continued)

OTHER PUBLICATIONS

International Search Report and the Written Opinion of the International Searching Authority issued on Apr. 14, 2010, in connection with PCT/US2010/024086.

*Primary Examiner* — Gary Elkins
*Assistant Examiner* — Christopher Demeree
(74) *Attorney, Agent, or Firm* — Levenfeld Pearlstein, LLC

(57) ABSTRACT

A rigid packaging container having an integral locking assembly is a rigid U-board having a bottom wall, a first sidewall, and a second sidewall, the bottom wall, the first sidewall and the second sidewall forming a channel. The first and second sidewalls each have a cut therethrough, forming a first channel section and a second channel section. An integral tab in the first sidewall of each of the first channel section and the second channel section is configured to form an integral locking assembly which may be pushed inwardly or pulled outwardly to secure the first channel section at an angle relative to the second channel section.

10 Claims, 1 Drawing Sheet

(56) References Cited

U.S. PATENT DOCUMENTS

| | | | | |
|---|---|---|---|---|
| 2,317,884 | A | 4/1943 | Clouston | |
| 2,391,791 | A | 12/1945 | Irving | |
| 2,418,248 | A | 4/1947 | Denton | |
| 2,575,898 | A | 11/1951 | Tadinger | |
| 2,712,880 | A | 7/1955 | Moore | |
| 2,718,980 | A | 9/1955 | Strom | |
| 2,731,167 | A | 1/1956 | Moore | |
| 2,741,390 | A | 4/1956 | Moore | |
| 2,774,504 | A | 12/1956 | Moore | |
| 2,778,559 | A | 1/1957 | Boitel | |
| 2,790,556 | A | 4/1957 | Burt | |
| 2,809,728 | A | 10/1957 | Olson | |
| 2,896,833 | A | 7/1959 | Markham | |
| 3,332,601 | A | 7/1967 | Frank | |
| 3,335,932 | A | 8/1967 | Brown | |
| 3,392,904 | A | 7/1968 | Wei | |
| 3,409,976 | A | 11/1968 | Kesling | |
| 3,425,544 | A | 2/1969 | Ayer et al. | |
| 3,472,571 | A | 10/1969 | Himelreich | |
| 3,481,457 | A | 12/1969 | Overton et al. | |
| 3,537,599 | A | 11/1970 | Jay | |
| 3,543,994 | A | 12/1970 | Clark | |
| 3,552,633 | A | 1/1971 | Ketler | |
| 3,656,614 | A | 4/1972 | Jacobson | |
| 3,669,338 | A | 6/1972 | Cornell et al. | |
| 3,744,659 | A | 7/1973 | Koehler | |
| 3,833,116 | A | 9/1974 | Howe | |
| 3,938,691 | A | 2/1976 | Dumas | |
| 4,067,442 | A | 1/1978 | Howe | |
| 4,126,222 | A | 11/1978 | Aust | |
| 4,191,288 | A | 3/1980 | Hostad | |
| 4,513,864 | A | 4/1985 | Libel | |
| 4,607,750 | A | 8/1986 | Valenti | |
| 4,629,069 | A | 12/1986 | Dugh | |
| 4,662,512 | A | 5/1987 | Durand | |
| 4,821,949 | A | 4/1989 | Booth | |
| 4,871,067 | A | 10/1989 | Valenti | |
| 4,898,279 | A | 2/1990 | Linnemann | |
| 4,976,374 | A | 12/1990 | Macaluso | |
| 5,141,149 | A | 8/1992 | Fulton | |
| 5,310,070 | A | 5/1994 | Haas et al. | |
| 5,431,985 | A | 7/1995 | Schilling | |
| 5,462,218 | A | 10/1995 | Grigsby et al. | |
| 5,513,819 | A | 5/1996 | Orange | |
| 5,657,872 | A | 8/1997 | Leftwich et al. | |
| 5,813,540 | A | 9/1998 | Vollbrecht et al. | |
| 5,947,290 | A | 9/1999 | Loeschen | |
| 6,027,017 | A | 2/2000 | Kuhn et al. | |
| 6,276,526 | B1 | 8/2001 | Miller et al. | |
| 6,334,535 | B1 * | 1/2002 | Korhonen | 206/453 |
| 6,382,447 | B1 | 5/2002 | Loeschen | |
| 6,457,636 | B1 | 10/2002 | Van De Ven et al. | |
| 6,499,655 | B1 | 12/2002 | Moen | |
| 6,527,119 | B1 | 3/2003 | Markert et al. | |
| 6,530,480 | B1 | 3/2003 | Hardy | |
| 6,540,080 | B2 | 4/2003 | Moreyra | |
| 6,651,875 | B2 * | 11/2003 | Chu | 229/191 |
| 6,794,018 | B2 | 9/2004 | Clark | |
| 6,896,174 | B2 | 5/2005 | Gosis | |
| 6,971,514 | B2 | 12/2005 | Vanderwerf et al. | |
| 7,661,579 | B2 | 2/2010 | Kruelle | |
| 2001/0017315 | A1 | 8/2001 | Baroudi | |
| 2005/0087663 | A1 | 4/2005 | Schroeder | |

FOREIGN PATENT DOCUMENTS

| | | |
|---|---|---|
| EP | 1291296 | 3/2003 |
| FR | 591300 | 7/1925 |
| FR | 2642404 | 8/1990 |
| GB | 537287 | 6/1941 |
| GB | 869651 | 6/1961 |
| GB | 870941 | 6/1961 |
| GB | 1004269 | 9/1965 |
| WO | 8909733 | 10/1989 |
| WO | 2004002837 A2 | 1/2004 |

* cited by examiner

CORNER LOCK BOARD

CROSS-REFERENCE TO RELATED APPLICATION

This application claims the benefit of priority of Provisional U.S. Patent Application Ser. No. 61/152,365, filed Feb. 13, 2009, entitled "CORNER LOCK BOARD".

BACKGROUND OF THE INVENTION

The present invention is directed to a packaging container. More particularly, the present invention pertains to a packaging container having an integral locking mechanism.

U-shaped packaging containers, or U-board, are known packaging material for many objects. The board is formed from a layered, or laminated, construction of paper and/or paper board that is subsequently formed into a U-shape (U-shaped cross-section). The board generally is rigid; that is, the walls are rigidly formed into the U-shape (transverse relative to the base) and are rigid longitudinally along the length of the channel. The walls do not fold down onto the base, nor can the board, without more, be folded length-wise onto itself.

U-board is used for a wide variety of commonly packaged items. U-board can be used to package long, fragile items to prevent creasing or other damage that may be caused by dropping, bumping, or general handling of the package. In a common use, U-board is used for such large items as doors and windows. The U-board is folded up and around the corners of the door or window, for example, and then is secured in place by tape, fastening strap, string, plastic wrap, and the like.

While U-board has been used with a great deal of success for packaging, typically, two people are required to properly package an item—one person to hold the U-board folded about the object, and another to secure the U-board around the item with the tape, strap, plastic, or the like. This can be time consuming and cumbersome.

Accordingly, there is a need for a rigid protective packaging that can be easily wrapped around an item. Desirably, such packaging minimizes the amount of additional materials and cost needed to fasten the unit together. More desirably, the U-board is readily made and usable, and has a high degree of integrity.

BRIEF SUMMARY OF THE INVENTION

A rigid packaging container having an integral locking assembly is formed from a rigid U-board having a bottom wall, a first sidewall, and a second sidewall. The bottom wall, the first sidewall, and the second sidewall together form a channel. The first and second sidewalls each have a cut therethrough, forming a first channel section and a second channel section. Multiple cuts may be made through the sidewalls to form a plurality of channel sections. A cut in the first sidewall is directly across from and parallel to a cut in the second sidewall.

An integral tab is formed in the first sidewall of each of the first channel section and the second channel section. Each of the integral tabs is rectangularly shaped, in an exemplary embodiment. The integral tabs are formed as cuts or slots in the sidewalls of the U-board. Thus, the integral tabs are formed of the same material which forms the rigid U-board; no extra material is added in order to fashion to integral tabs. In an exemplary embodiment, three slits are formed to create a rectangularly-shaped rigid tab or flap; the fourth side remains continuous or uninterrupted with the sidewall of the U-board.

In an initial position, the integral tab in the first sidewall of the first channel section is rotated ninety degrees relative to the integral tab in the first sidewall of the second channel section. In a second position, the first channel section is positioned perpendicular to the second channel section, and the integral tab in the sidewalls of the first channel section is rotated about ninety (90) degrees. Thus, in the second position, the integral tab of the first channel section is parallel to the integral tab of the second channel section.

In an embodiment, an integral tab is not only present in each of the first sidewall channel sections, integral tabs are also present in the second sidewall of each of the first channel section and in the second channel section. As with the integral tabs in the first sidewall, the integral tab of the second sidewall in the first channel section is formed rotated ninety degrees relative to the integral tab formed in the second sidewall of the second channel section in an initial position.

The integral tab of the first channel section and the integral tab of the second channel section are configured to form an integral locking assembly for holding the first channel section at an angle relative to the second channel section, wherein the angle is a right angle in a preferred embodiment. Similarly, the integral tab of the first channel section of the second sidewall and the integral tab of the second channel section of the second sidewall are configured to form an integral locking assembly for holding the first channel section at an angle relative to the second channel section.

The integral locking assembly is configured to be pressed in an inward direction relative to the channel or pulled in an outward direction relative to the channel. The integral locking assembly is configured to secure the first channel section in a second position relative to the second channel section.

These and other features and advantages of the present invention will be apparent from the following detailed description, in conjunction with the appended claims.

BRIEF DESCRIPTION OF THE SEVERAL VIEWS OF THE DRAWINGS

The benefits and advantages of the present invention will become more readily apparent to those of ordinary skill in the relevant art after reviewing the following detailed description and accompanying drawings, wherein.

DETAILED DESCRIPTION OF THE INVENTION

Figure 1:
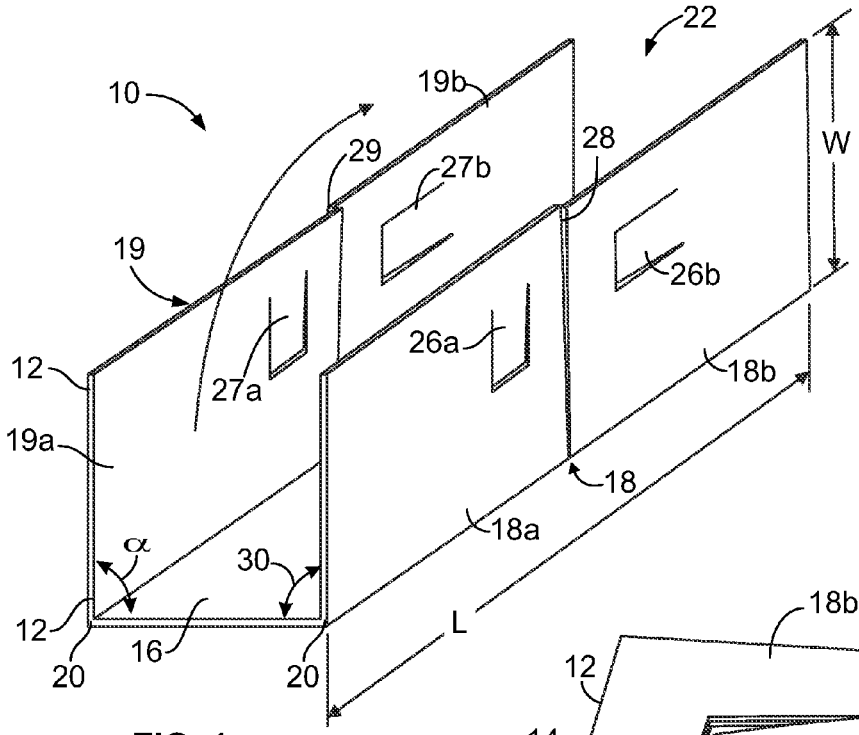
FIG. 1 is a perspective view of the corner lock board embodying the principles of the present invention.
Figure 3:
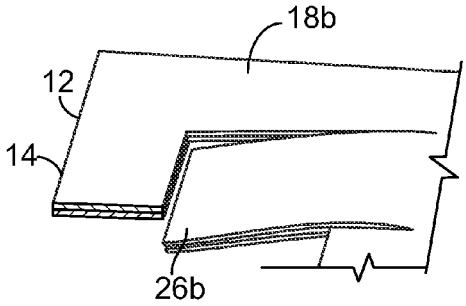
FIG. 3 is an enlarged perspective view of the tabs of the corner lock board.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiment illustrated.

It should be further understood that the title of this section of this specification, namely, "Detailed Description Of The Invention", relates to a requirement of the United States Patent Office, and does not imply, nor should be inferred to limit the subject matter disclosed herein.

Figure 2:
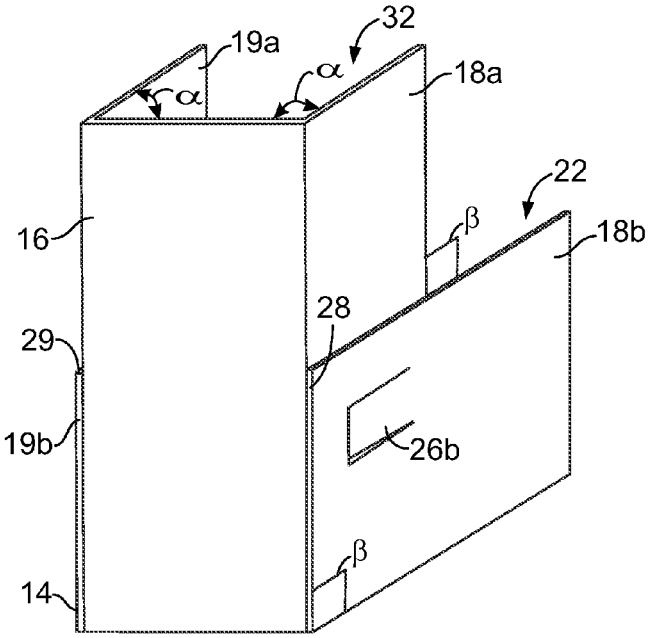
FIG. 2 is a perspective view of the corner lock board in a locked position.

Turning now to the figures and in particular FIGS. 1 and 2, the corner lock board 10, although typically having a generally U-shaped cross-section 12, is formed from a material having a channel-like or squared U-shape, with a flat or near-flat (e.g., planar) bottom wall 16 and straight (e.g., generally planar) upstanding side walls 18, 19. The sidewalls 18, 19 are rigid longitudinally along a length L to form a U-shaped channel 22. The corners 20 are typically formed having a radius of curvature α (i.e., rounded), however, the corners may be formed having relatively sharp angles. Nevertheless, for purposes of the present disclosure, the corner lock board 10 is referred to as "U-shaped".

Notches or cuts 28, 29, such as a mitered cuts or straight cuts, are formed through a width W of the side walls 18, 19. Cutouts or tab-like areas 26*a*, 27*a* and 26*b*, 27*b* are formed in the sidewalls 18, 19, on opposing sides of the notch 24, 25 in each of the sidewalls 18, 19, respectively. In an exemplary embodiment, three slits are formed to create a rectangularly-shaped rigid tab or flap; the fourth side remains continuous or uninterrupted with the sidewall of the U-board.

The tabs 26, 27 are made from the same material 12 as the U-board and may also be reinforced with reinforcing material 14. Tab 26 is rotated ninety (90) degrees relative to Tab 27 in an initial position (shown in FIG. 1). The tabs 26, 27 in a preferred embodiment, are rectangular in shape; it will be appreciated by those skilled in the art that tabs having other geometric profiles, such as squares, triangles, and rounded or curved profiles are also contemplated and anticipated and are within the scope of the present invention.

The U-board 10 is formed in a layered construction (e.g., a lamination) of strips of material 12. The material 12 is preferably paper and/or paper board, but it is anticipated that other non-paper type material may be used. The laminations of strips of material 12 are formed by using means known to those skilled in the art, and preferably by adhering layers together with an adhesive; however, alternative means to adhere the layers of material 12 into a board 10 may be used. In a commonly used method, the laminations and adhesive are made in a wet environment (a wet adhesive), the sidewalls 18, 19 are then folded up from the bottom wall 16 and allowed to dry. The result is the rigid U-shape illustrated wherein the sidewalls 18, 19 do not fold down onto the bottom wall 16 in the direction (as shown by directional arrow 30), but are formed at an angle α, about a 90 degree angle relative to the bottom wall 16.

It will be appreciated that while the board container material 12 is typically a paper or paperboard-based material, a reinforcing material 14 may also be used. The reinforcing material 14 can be a paper or paperboard-based material, a polymeric material (such as high-density polyethylene (HDPE), low density polyethylene (LDPE) or the like), or any other suitable material that can be inserted between the container material 12 layers in the desired formation (e.g., wet adhesive) process to provide enhanced strength. It will also be appreciated that the reinforcing material 14 can be formed from whole or non-perforated material, perforated material, mesh-like (e.g. grid patterned) material and the like, the latter two having open areas.

The mesh-like material, having open areas, can facilitate bonding by allowing communication of adhesive between layers of material 12, 14 and around the reinforcing material layers 14. In an embodiment of the corner lock board 10, lamination strips are of the same length and/or the same material. In another embodiment of the corner lock board 10, one or more narrower strips of material 14 is used as reinforcing material and is positioned on the top of one or more wider strips of container material 12, of differing or of the same width, with an adhesive means placed between the two layers 12, 14.

A method of using the corner lock board 10 includes folding the corner lock board 10 around the particular item at an angle β. In an exemplary embodiment, β is about ninety (90) degrees. When the corner board 10 is folded, as shown in FIG. 2, tabs 26*a*, 27*a* are rotated such that tabs 26*a*, 27*a* are parallel to tabs 26*b*, 27*b*. The tabs 25*a*, 26*a*, 25*b*, 26*b*, can then be pressed together, either inwardly in a first direction, or pulled outwardly in a second direction, to form an integral locking assembly that is integral with the corner lock board 10.

Advantages to the present corner lock board will be appreciated by those skilled in the art. The integral locking tabs lock the corner lock board in a use-position, requiring only one person to position the corner lock board around an item. The tabs are formed from the walls of the corner lock board such that no extra material or waste is produced and the tabs are the same strength as portions of the corner lock board. In addition, because of the rotation and position of the tabs during folding, the tabs facilitate positioning the corner lock board in a ninety degree angle and keeping the side channels upright; once the tabs have been interlocked, the tabs prevent the side channels from being folded forward (greater than 90 degrees) into the bottom channel, and the tabs prevent the side channels from falling back into the initial position. The tabs provide consistency in creating fixed 90 degree angles in the corner lock board, such that fastening mechanisms can be put in place quickly and easily by one user. Furthermore, such tabs allow multiple corner lock boards to be telescoped together to form longer integral locking U-board which can subsequently be folded around an item.

All patents referred to herein, are incorporated herein by reference, whether or not specifically done so within the text of this disclosure. In the present disclosure, the words "a" or "an" are to be taken to include both the singular and the plural. Conversely, any reference to plural items shall, where appropriate, include the singular.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A rigid packaging container having an integral locking assembly comprising:

a rigid U-board having a bottom wall, a first sidewall and a second sidewall substantially parallel to the first sidewall, the bottom wall, the first sidewall and the second sidewall forming a channel, the first and second sidewalls being rigid relative to the bottom wall, the bottom wall and first and second side walls and the intersection of the bottom wall and the respective first and second side walls being rigid relative to one another such that the first and second side walls are not foldable onto the bottom wall, the first and second sidewalls each having a cut therethrough and forming a first channel section and a second channel section, and an integral tab in the first sidewall of each of the first channel section and the second channel section, the integral tabs being formed in the first sidewalls of the first and second channel sections spaced from any peripheral edge of the first and second sidewalls, the integral tab in the first sidewall of the first channel section rotated ninety degrees relative to the integral tab formed in the first sidewall of the second channel section in an initial position, wherein the integral tab of the first channel section and the integral tab of the second channel section are configured to engage one another to form an integral locking assembly for holding the first channel section at an angle relative to the second channel section.

2. The packaging container of claim 1 wherein the angle is a right angle.

3. The packaging container of claim 1 including an integral tab in the second sidewall of each of the first channel section and the second channel section, wherein the integral tab of the second sidewall in the first channel section is formed rotated ninety degrees relative to the integral tab formed in the second sidewall of the second channel section in an initial position.

4. The packaging container of claim 3 wherein the integral tab of the first channel section of the second sidewall and the integral tab of the second channel section of the second sidewall are configured to form an integral locking assembly for holding the first channel section at an angle relative to the second channel section.

5. The packaging container of claim 1 wherein each of the integral tabs are rectangularly shaped.

6. The packaging container of claim 1 wherein the integral tab of the first channel section is parallel to the integral tab of the second channel section in a second position.

7. The packaging container of claim 1, wherein each of the integral tabs is formed of a material which forms the rigid U-board.

8. The packaging container of claim 1 wherein the integral locking assembly is configured to be pressed in an inward direction relative to the channel.

9. The packaging container of claim 1 wherein the integral locking assembly is configured to be pulled in an outward direction relative to the channel.

10. The packaging container of claim 1 wherein the integral locking assembly is configured to secure the first channel section in a second position relative to the second channel section.

* * * * *